United States Patent [19]

Switlik, Jr. et al.

[11] Patent Number: 4,865,573

[45] Date of Patent: Sep. 12, 1989

[54] INFLATABLE LIFE VEST OF THE SINGLE-ATTACHMENT, SINGLE-ADJUSTMENT TYPE

[75] Inventors: Richard Switlik, Jr., Bay Head; Leonard R. Rupertus, Browns Mills, both of N.J.

[73] Assignee: Switlik Parachute Company, Inc., Trenton, N.J.

[21] Appl. No.: 33,312

[22] Filed: Apr. 1, 1987

[51] Int. Cl.[4] ..... B63C 9/16

[52] U.S. Cl. ..... 441/92; 441/118

[58] Field of Search ..... 441/108–119

[56] References Cited

U.S. PATENT DOCUMENTS

| | | | |
|---|---|---|---|
| 928,465 | 7/1909 | Krieger et al. | 441/115 |
| 3,076,207 | 2/1963 | Manhart | 441/118 |
| 3,101,492 | 8/1963 | Martin | 441/114 |
| 3,329,982 | 7/1967 | Zannoni | 441/118 X |

*Primary Examiner*—Sherman D. Basinger

*Attorney, Agent, or Firm*—Sperry, Zoda & Kane

[57] ABSTRACT

A life vest of the inflatable type is disclosed in which the inflation cell or cells are combined with a back panel and a single-attachment, single-adjustment, waist strap. The single-attachment waist strap may be permanent, or alternatively separable. The waist strap is stitched or otherwise non-movably connected to the inflatable cell or cells, and has a sliding connection to the back panel, for self-adjustability when tightened about the waist of the user, in a preferred embodiment.

1 Claim, 3 Drawing Sheets

INFLATABLE LIFE VEST OF THE SINGLE-ATTACHMENT, SINGLE-ADJUSTMENT TYPE

BACKGROUND OF THE INVENTION

1. Field Of The Invention

The present invention relates generally to inflatable life vests, especially those of the type normally stored in a very small area when uninflated, and hence widely used on commercial aircraft throughout the world for passenger protection.

In a more particular sense, the invention has reference to life vests of the character described which are usually of the double cell type in which each cell is out of communication with and is inflated separately from the other. In a still more particular sense, the invention relates to an inflatable life vest of the type including a single waist strap having a single-attachment and single-adjustment as distinguished from the type (also widely used) having double straps the ends of which are pulled for the purpose of tightening the straps about the wearer's body.

The term "single-attachment", as used herein, refers to a life vest configuration wherein the user is required to make no more than one attachment to secure the life vest to his or her person. This requirement is met when, for example, a single waist strap is used and which has at one end a single buckle to which the wearer attaches or connects the other end of the strap in the event the strap ends have not been pre-attached. The term "single-adjustment" as used herein refers to a situation in which the wearer need make no more than one adjustment for tightening the waist strap about the waist for a comfortable fit.

2. Description Of The Prior Art

Airline passenger life vests of the inflatable type commonly utilize dual, superposed, inflatable cells having a neck opening, and designed in such a manner that the cells overlie the chest of the wearer and will right the wearer should the wearer be in the water in a face-down position, thus to provide a proper flotation attitude, with the wearer's head being so supported as to be clear of the water line.

A life vest of the character described incorporates a waist strap or straps, so designed that when the life vest is donned by the wearer, the strap or straps can be pulled tight about the waist so as to assure that the life vest will be held upon the wearer's body in such a manner as to assure that the wearer will be supported in the necessary flotation attitude when the cells are inflated.

Commonly, airline passenger life vests of the dual cell type have heretofore been made in two basic ways. In one form of life vest now in commercial use, a single waist strap is provided, extending fully about the wearer's waist when the vest is donned, and having an adjusting buckle at the front. In this form of vest, there is provided a single end of the waist strap, which is pulled to effect the desired adjustment of the strap to the waist size of the wearer.

A life vest of this type does not include a back panel, that is, there is nothing at the back of the life vest that offers a means of making a connection to the back portion of the waist strap. As a result, it has been demonstrated that a life vest of this type has some tendency to flip back off the head of the wearer to produce a potentially life-threatening situation.

A more common form of airline passenger life vest, also of the dual cell type, utilizes a back panel, that is, a fabric member having an upper end secured to the dual cell means, and having a free lower end that is stitched to double waist straps. In this form of vest, the waist straps extend around the sides of the wearer's waist, to the front, and have individual ends and individual adjusting buckles, so that both ends are pulled to tighten the strap around the wearer's waist. This reduces the amount of time necessary to tighten the waist strap about the waist, and in addition, reduces the length of the "tail" of each strap, that is, the portion of the strap that hangs free from the waist after the strap has been tightened. The straps must be made to accommodate both small children and large adults of substantial girth. Thus, particularly when the vest is donned by a child, the "tail" may be so long as to be subject to being stepped on or entangled.

The Federal Aviation Administration has, under law, the responsibility of establishing performance standards for life vests of this type. Perceiving an advantage in standardizing the vests now in use, the Federal Aviation Administration (FAA) has recently issued an order that the means for retaining a life vest of this type upon the wearer must require that the wearer secure no more than one attachment and make no more than one adjustment for fit. This means that vests of the type described above having a double waist strap are, effectively, hereafter prohibited.

It has been suggested by experts in the field, and demonstrated by appropriate test procedures, that the donning and retention characteristics of a single-adjustment, single-attachment configuration may be inferior to a double adjustment vest, especially when the vest is worn by a child, and in any event, offers no advantages over vests of the double waist strap type in ease of donning.

Particularly with respect to retention, the absence of a back panel, which so far as is known has never heretofore been usable in a life vest of the single-adjustment, single-attachment type, has produced poor retention characteristics, even if the vest is donned correctly, when passengers jump into the water, or are subjected to heavy wave action.

It becomes important, accordingly, in view of the promulgation of the FAA order described above, and for that matter even in the absence of such an order, to improve the retention characteristics and ease of donning of airline passenger life vests of the dual inflatable cell, single-attachment, single-adjustment waist strap type. Heretofore, the prior art has offered no solution to this particular problem and the main object of the present invention is to provide that solution.

SUMMARY OF THE INVENTION

Summarized briefly, the invention is an inflatable life vest, preferably of the dual air chamber type, in which a back panel is secured to the cells providing such chambers, in such a way as to provide a comfortable neck opening, without the necessity of a separate gusset such as has heretofore been used. The back panel, when the vest is donned, extends down the back of the wearer, terminating approximately at the waistline. A single waist strap has a floating connection to the lower end of the back panel, as distinguished from waist straps of the double type, which are connected to a back panel permanently.

The invention utilizes a single waist strap, which as indicated above floats within the lower end portion of the back panel, and which extends about the waist of the wearer when the vest is donned. At the front, the single waist strap is stitched adjacent one end to a connecting element extending down from the lower end of the inflatable cell means. To this end of the strap there is connected a buckle. The other end of the strap is passed through the buckle, and when pulled upon, causes the entire waist strap to be tightened about the wearer's waist. The buckle may or may not be of the separable type, as desired.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 2:
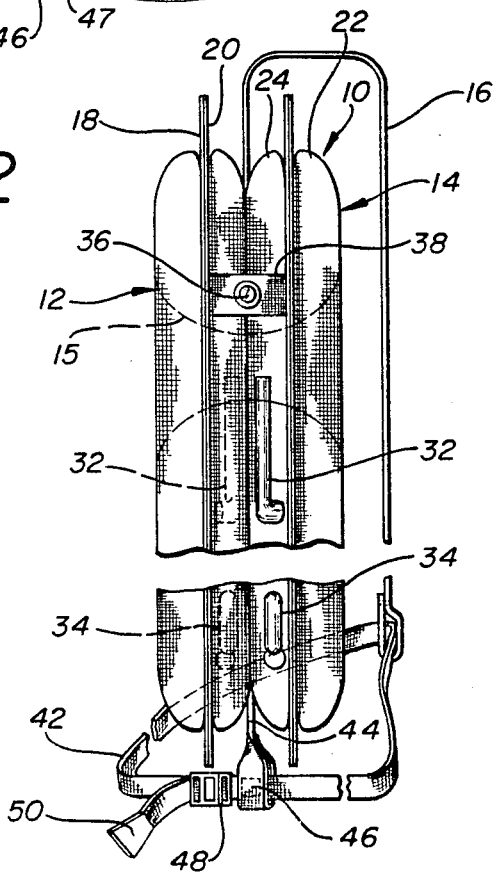
FIG. 2 is an enlarged side elevational view of the life vest in which the waist strap appears in perspective, the cells being inflated and portions being broken away.
Figure 3:
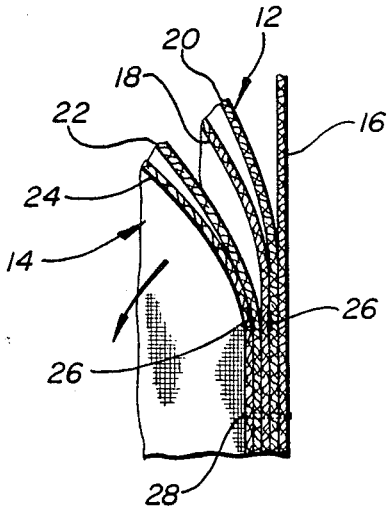
FIG. 3 is a still further enlarged, fragmentary, detail sectional view showing the connection of the back panel to the inflatable cells, during an intermediate stage of manufacture of the life vest.
Figure 4:
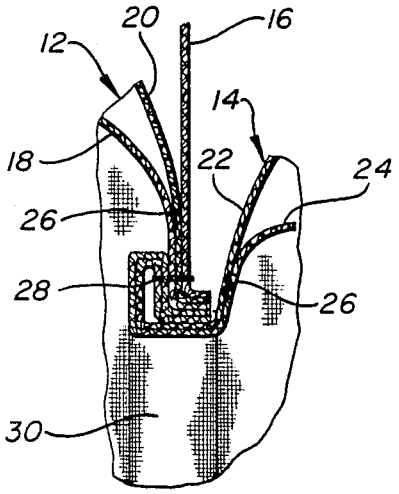
FIG. 4 is a view on the same cutting plane as FIG. 3, taken substantially on line 4—4 of FIG. 1, in which the portion of the vest shown in FIG. 3 is illustrated in the completed vest.
Figure 5:
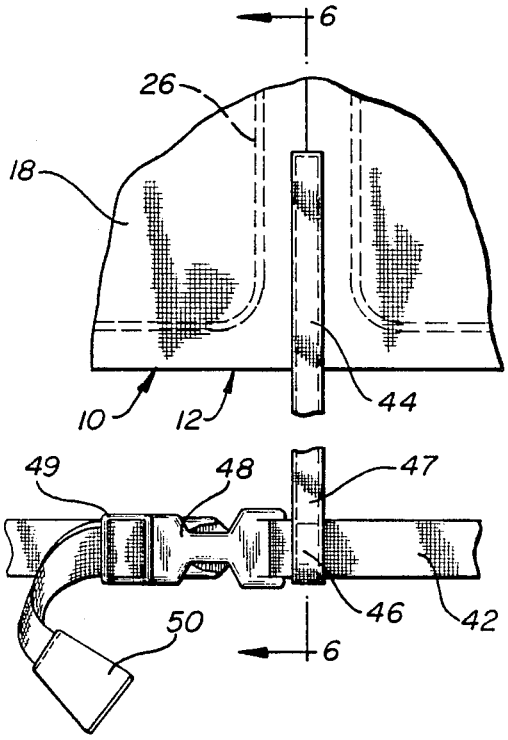
FIG. 5 is a greatly enlarged, fragmentary front elevational view of the deflated vest, showing the lower portion of the front of the vest.

An airline passenger life vest 10 includes independently inflatable twin cells 12, 14 of approximately U-shaped configuration having a common neck opening 15. Stitched at one end to the cells between the same (FIGS. 1 and 2) is an elongated, wide, fabric strip forming a back panel 16. The cells are identically constructed, each with outer and inner cell panels, the cell 12 having outer and inner panels 18, 20 and the cell 14 having outer and inner panels 22, 24 (FIG. 2). At their peripheries, the outer and inner panels of each cell are heat sealed as at 26 (FIGS. 3, 4, and 5).

An important feature is provided by the particular assembly of the back panel and the twin cells to define the neck receiving opening 15. In use of a life vest of the described type over a long period of time, the vest material may chafe one's skin, and accordingly, in the illustrated preferred embodiment (see FIGS. 3 and 4), the back panel 16 is first stitched as at 28 at one end thereof, to the fabric outer and inner panels 18, 20, 22, 24. Back panel 16, at this stage of the operation, overlies the inner cell panel 20 of cell 12, which in turn is in face-to-face contact with the outer panel 18 of cell 12. The outer panel 18 of cell 12 is in face-to-face contact with the outer panel 22 of cell 14, and overlying panel 22 is the inner panel 24. The several panels 18, 20, 22, 24, and panel 16 are disposed with their edges in registration, after which stitching is applied as at 28 about the neck opening. Then, panels 22, 24 are folded in the direction of the arrow shown in FIG. 3, to the final position thereof shown in FIG. 4, in which the panels 22, 24 have been passed through the neck receiving opening 15 to define a chafe-resistant neck band 30 formed of the material of the inner panel 24 of cell 14.

Figure 1:
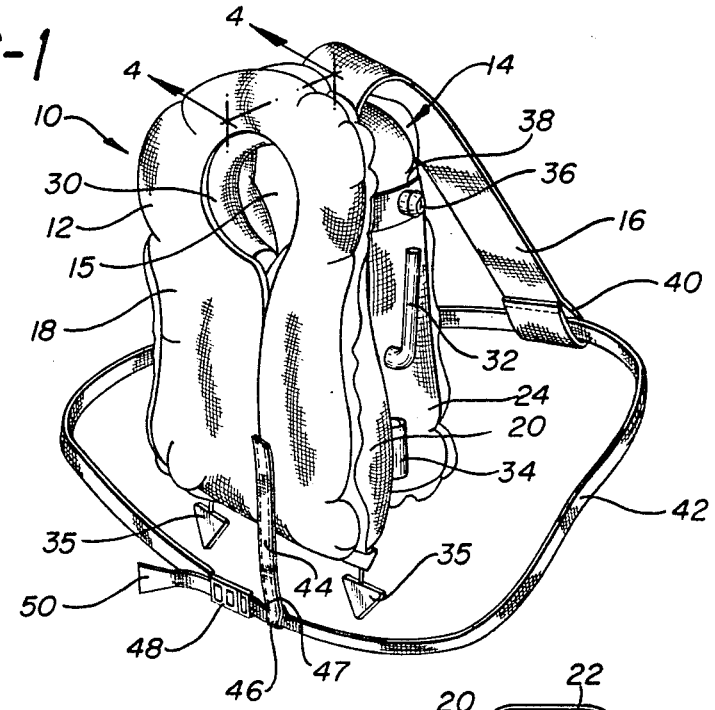
FIG. 1 is a perspective view of an inflatable life vest of the dual air chamber type, constructed in accordance with the present invention, the cells being shown in an inflated condition.

As required by Federal regulation, the respective cells are equipped with oral inflation tubes 32 and with $CO_2$ cylinders 34 provided with pull tabs 35 (FIG. 1).

Also provided are connecting webbings 38, connected between the peripheries of the cells at opposite sides of the neck receiving opening. A water activated locator light 36 is mounted in one of the webbings 38, if desired.

Tubes 32, cylinders 34 and light 36 are conventional as is the basic concept of independently inflatable twin cells and do not constitute part of the present invention.

Figure 6:
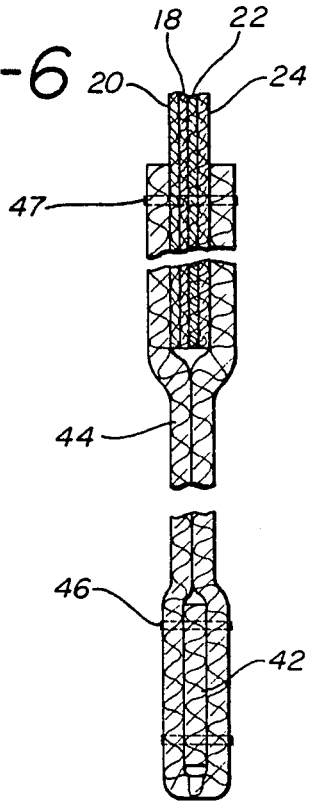
FIG. 6 is a still further enlarged, detail, fragmentary sectional view substantially on line 6—6 of FIG. 5, illustrating the connection of the waist strap to the cell means at the front of the life vest.
Figure 7:
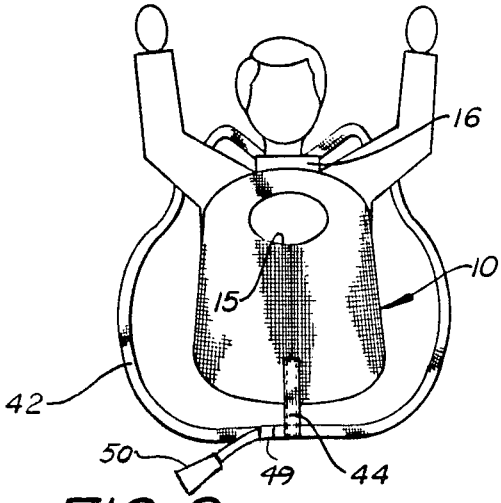
FIGS. 7–12 are views in the form of instructural graphics of the type applied to the life vests themselves showing, step by step, the procedure of donning the vest.

In accordance with the invention, the free, lower end of back panel 16 is provided with a transverse, open-ended loop or hem 40, in which is slidably received the mid-portion of an elongated waist strap 42. Adjacent one end of the waist strap, the lower end of a connecting strip 44 is stitched or otherwise permanently secured as at 46 to the waist strap, the upper end of said strip being secured by stitching 47 to the respective cells (see FIGS. 2, 5 and 6).

Adjacent the connecting strip 44, there is secured to the waist strap an adjusting buckle 48 of conventional design. Purely for the purpose of example, the buckle 48 illustrated in FIG. 5 is of the separable type. However, it could be non-separable. It is mainly important, for the purpose of the present invention, that regardless of the type of buckle 48 that is used, it should have an adjustment loop 49 (FIG. 5) through which is passed the other end of the waist strap. The end of the strap passed through the adjustment loop of the buckle has a pull tab 50.

Connecting strip 44 is doubled on itself (FIG. 6) so that the several cell panels are sandwiched between the end portions of strip 44.

Heretofore, in a life vest of the single strap type the life vest has not been equipped with a back panel, so that the waist strap has been connected to the cells only by means of the connecting strip 44. As discussed previously herein, this has been a relatively unsafe arrangement, in the view of many experts in the field, and only a comparatively few airlines have selected this type of vest.

Accordingly, the promulgation of an order requiring that the means for retaining the life preserver on the wearer have no more than one attachment and require no more than one adjustment for fit, would hereinafter, as a practical matter, eliminate double straps, each with its own adjusting buckle.

To overcome this problem, the vest disclosed herein provides the single-attachment, single-adjustment feature that meets the requirements of the FAA order previously discussed herein. At the same time, however, it adds the extremely important feature of combining a single strap with a back panel 16. It does this by permanently attaching one end portion of the single strap, adjacent the adjustment buckle 48, to a connecting strip secured to and extending downwardly from the lower ends of the two cells, while providing a slidable connection of the intermediate portion of the strap to the lower end of a back panel 16 secured at its upper end to and between the cells.

As a result, in use, the vest can be donned as shown in FIGS. 7–12.

These figures of the drawing are simplified graphics of the type that would be depicted on the outer cell panels 18, 22 to instruct a user in donning the vest in an emergency. A vest of this type is completely reversible, since the back panel and the strip 44 are symmetrically disposed relative to the cells 12, 14. This allows the back panel to be flipped into overlying relation to either cell. It is therefore desirable that the pictorial donning instructions be visible from either side of the preserver.

Figure 8:
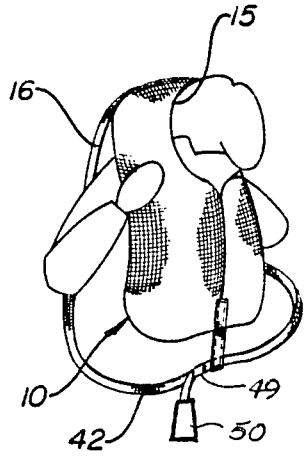
Figure 9:
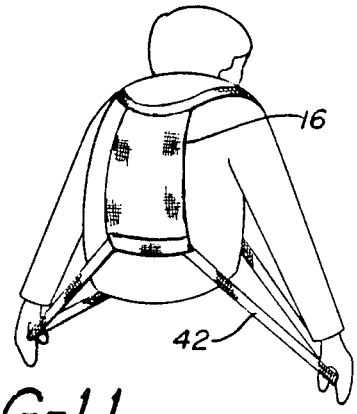
Figure 10:
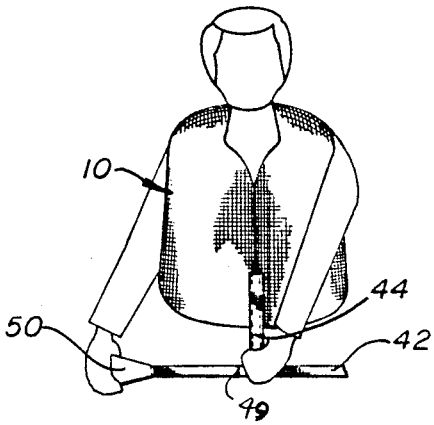
Figure 11:
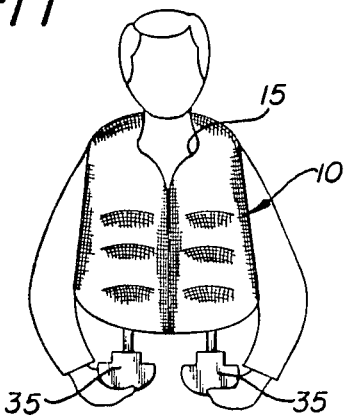
Figure 12:
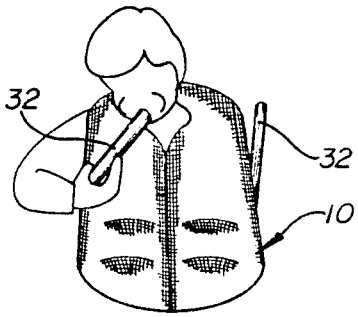

As shown, with the life preserver before him along with the back panel 16, the wearer thrusts his or her arms between the cells and the respective side portions of the strap 42. Then the device as shown in FIG. 8 is slipped over one's head, so that the back panel 16 extends down the wearer's back. In FIG. 9, it is seen that one pulls outwardly and downwardly upon the side portions of the waist strap to assure that they will be clear of each other. Then, in FIG. 10 one pulls on the tab 50 while grasping the connecting strip 44, to tighten the waist strap about the waist. Then, one pulls downwardly on the tabs 35 to release the gas from cylinders 34 for inflating the cells. If there is a malfunction of the pressurized inflation means, one can orally inflate the cells by means of the tubes 32, as shown in FIG. 12.

The vest is also readily used on children. An adult can put the vest on a child in the same way as illustrated in FIGS. 7–12, or alternatively, can pass the side portions of the strap up between the child's legs before pulling it tight. Pictorial instructions for putting the vest on a small child are also provided on vests of this type.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

we claim:

1. A life vest comprising:

(a) inflatable cell means having a neck opening;

(b) a back panel connected at one end to the cell means and having a second end;

(c) a single waist strap having first and second ends and connected intermediate said ends to the second end of the back panel for free sliding movement therein;

(d) a connecting strap affixed both to the waist strap inwardly from the first end of the waist strap, and to the cell means whereby to connect said waist strap to the cell means; and (e) a single connector means on one of said ends of the waist strap receiving the other end thereof and adapted for adjusting the length of the waist strap to the waist size of a wearer, said connector means comprising the sole means over the full length of the waist strap for connecting the ends of the waist strap about the waist of the wearer and for adjusting the waist strap length to the wearer's waist size.

* * * * *